United States Patent [19]

Ross

[11] Patent Number: 4,962,954

[45] Date of Patent: Oct. 16, 1990

[54] BURGLAR BAR SYSTEM INCORPORATING A HAND OPERATED LATCH MECHANISM OPERABLE FROM THE BUILDING INTERIOR

[76] Inventor: Barry Ross, 1910 Turner, Houston, Tex. 77093

[21] Appl. No.: 334,210

[22] Filed: Apr. 6, 1989

[51] Int. Cl.[5] ..... E05C 1/16

[52] U.S. Cl. ..... 292/175; 292/152; 292/302; 292/DIG. 63; 49/56

[58] Field of Search ..... 292/302, 183, 189, 152, 292/341.15, DIG. 13, DIG. 63, 175; 49/55, 56

[56] References Cited

U.S. PATENT DOCUMENTS 2,580,495 1/1952 Woods ..... 292/152 X 3,109,900 11/1963 Van Hook ..... 292/DIG. 13 X 4,249,345 2/1981 Littleton ..... 49/56

4,630,396 12/1986 Zvi et al. ..... 49/56 X 4,817,334 4/1989 Badger et al. ..... 49/56 X

*Primary Examiner*—Richard E. Moore

*Attorney, Agent, or Firm*—Gunn, Lee & Miller

[57] ABSTRACT

A latch or lock enabling a hinged burglar bar gate to be opened by a person on the interior of the protected building. Intruders cannot reach the lock. It includes a housing with an opening for hand engagement. In the opening, a spring supported lock member is pushed by hand to unlatch. Hand operation is constrained by the housing deployment, limiting use to a person near the housing and on the interior of the burglar bar gate.

10 Claims, 1 Drawing Sheet

FIG. 1
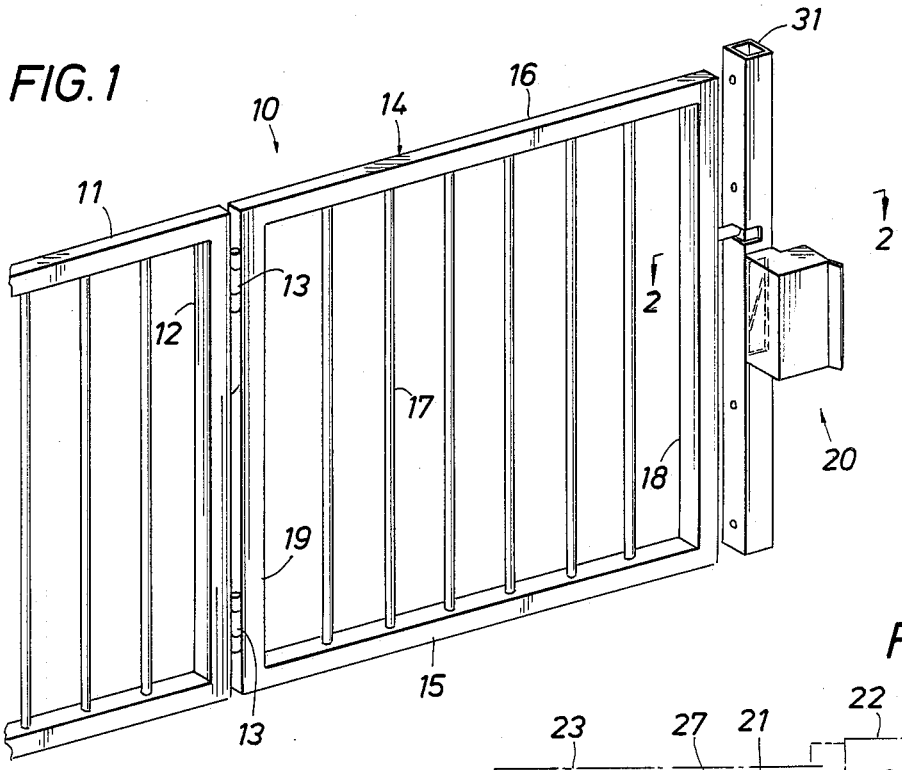
FIG. 2
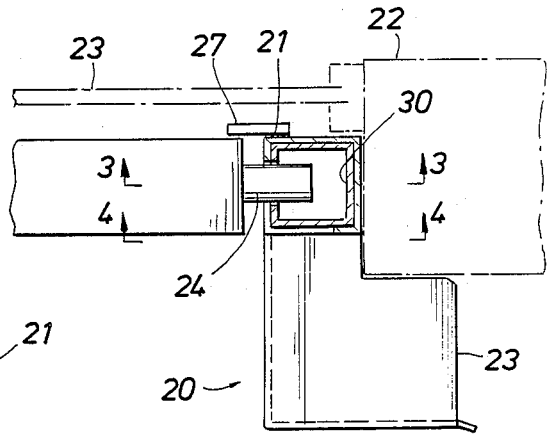
FIG. 3
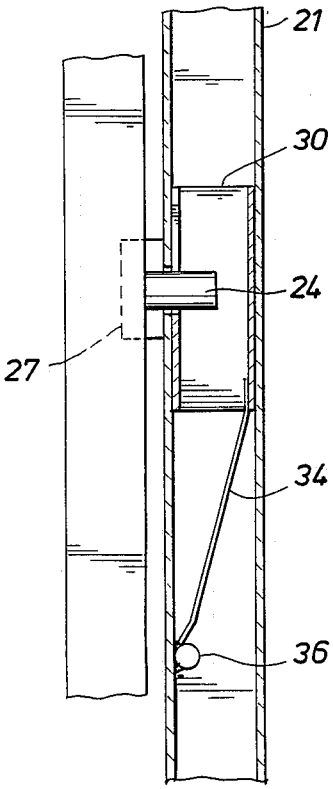
FIG. 4
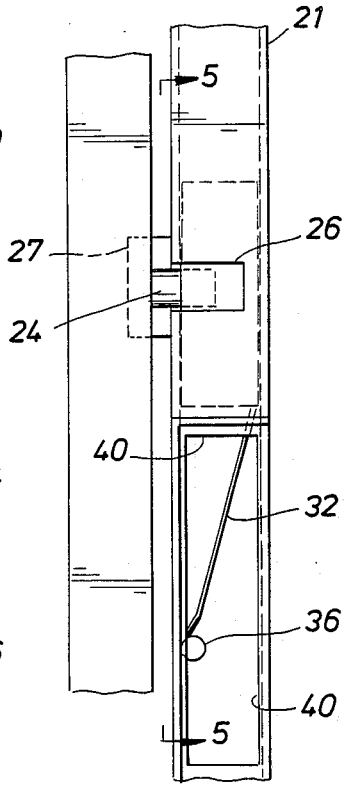
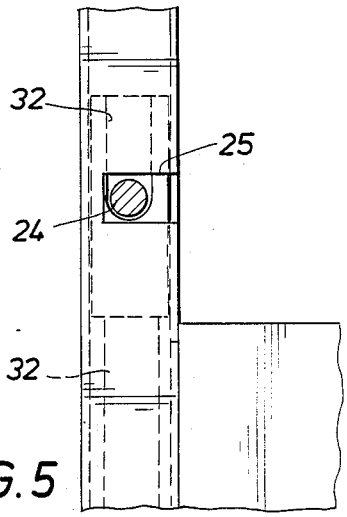
FIG. 5

BURGLAR BAR SYSTEM INCORPORATING A HAND OPERATED LATCH MECHANISM OPERABLE FROM THE BUILDING INTERIOR

BACKGROUND OF THE DISCLOSURE

This disclosure is directed to a latch or lock mechanism for use with a set of burglar bars. Burglar bars are often installed on buildings to provide security from intruders. The present apparatus is a burglar bar system which is particularly adapted for installation inside a window, typically parallel to the window and anchored on the surrounding window frame. Intruders typically enter buildings either through the doors or windows. The present apparatus is a set of burglar bars which keep burglars from entry through a large opening such as a window or the like. It can also be used with patio doors and other installations which are normally closed by a window of some size. One of the problems with burglar bars is that they are preferably mounted on hinges so that they can be opened. Obviously, they are left closed and locked most of the time. When closed and locked, they increase the fire hazard to occupants of the structure. Thus, a fire, particularly the sort that occurs in the middle of the night, may trap residents of a building in the room protected by the burglar bars, and this has occasioned the death by smoke, suffocation or fire of many building occupants. Without the burglar bars, they could easily escape through the windows. Accordingly, many building regulatory agencies including fire departments have mandated that burglar bars be mounted on hinges so that they can swing inwardly and open. The burglar security, however, is contingent on the burglar bars being provided with a lock or latch mechanism not readily accessed by an intruder from the exterior. A key operated lock is not an acceptable lock mechanism; that is, the key lock mechanism is dangerous because the burglar bars are typically closed and locked, often with a quality pad lock, and the key is thereafter misplaced. Then, in a moment of panic when a structural fire might occur and escape is mandated in a few seconds, the occupant of the room cannot find the key. This is even more dangerous for those who are rudely awakened in the middle of the night with alarm conditions indicative of a fire which is a life threatening event. The problem is further compounded because the occupant of the room (i.e., a bedroom in a home) may well be an older person who does not remember where the key might be or perhaps a child too young to operate the key and padlock. Even where a stable adult is able to find a key for the padlock, lighting may be difficult or impossible and may well defeat operation of the equipment so that the protective burglar bars installed in the structure may well form an unintended prison for the occupant.

The present apparatus is however and improved locking system for a hinged burglar bar gate mounted in a window which assists in locking and unlocking. It is hand operated. It is mounted so that an intruder cannot penetrate the window and reach into the room and thereby operate the system. Rather, the lock mechanism is accessed by a user only from the interior of the room. This access limitation permits the installation of a lock which requires no padlock. Because the intruder cannot reach the device in an operative fashion through the window, it more than serves the purpose of providing burglar bars for installation in a window which cannot be opened from the exterior and yet which can be opened from the interior by anyone able to accept such instructions, even including relatively young children. This permits easy access to the latching mechanism which operates rather simply so that opening or release can be accomplished quickly.

With this in the background, the present apparatus is summarized as a hinge mounted gate adapted to be mounted in a window or other glass covered opening in a building. Access to the lock is limited; it is completely inaccessible by an intruder from the exterior, and is readily accessible by an occupant of the building. It complies with fire codes and the like in that it provides a lock which can be operated without searching for a key and yet which is secure against the intruder. So to speak, it is constructed and positioned to prevent the intruder from reaching the lock. Even the longest armed intruder cannot reach the locking mechanism because it is mounted in such a fashion as to preclude reaching through the window. In one embodiment, an upstanding frame member having a pair of spaced hinges supports a swinging gate made of burglar bars. This is mounted in a window. The gate has a latch bar which protrudes preferably horizontally. The lock mechanism of the disclosure incorporates an upstanding frame member which is ideally anchored to the window frame, as for instance by use of long bolts. The anchored upstanding frame member supports a housing which is open on one side. When installed, the housing opening faces the interior of the room through an opening, and the opening is located on the remote face of the rectangular housing. That is to say, it is sufficiently far from the window when installed that an intruder cannot reach into the opening. On the interior of the opening, the latching mechanism includes a second opening which requires the user to curl his fingers into the equipment to release a spring loaded latch mechanism. When released, it dropped downwardly by gravity and is therefore latched or unlatched by simple motion of the user initiating gravity movement. When unlatched, release occurs. The present apparatus thus incorporates a gravity operated, notched, rectangular, slidably mounted frame member which is enclosed within another rectangular or upright frame member. The two have matching notches to engage the latching bar; when the interior member is raised, it provides a U-shaped slot which encompasses the latching bar for locking purposes. When moved downwardly, unlatching occurs. When moved upwardly, latching occurs and is maintained by the action of a leaf spring which is hand released for engagement and disengagement.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a perspective view of a hinge mounted gate which is closed and latched by the latching mechanism in accordance with the teachings of the present disclosure which provides a latch that cannot be operated by an intruder reaching through the burglar bars;

FIG. 2 is a sectional view taken along the line 2—2 of FIG. 1 showing an upstanding frame member which is bolted or otherwise attached to a portion of the window frame and mounted so that access is limited to those on the interior of the structure protected by the burglar bars of FIG. 1;

FIG. 3 is a sectional view taken along the cut line at 3—3 of FIG. 2 showing the latch bar engaging the upstanding frame member and the movable hollow lock bar on the interior;

FIG. 4 is an elevation view of the lock bar shown in FIG. 3 further showing capture of the latching bar in the movable lock bar on the interior of the frame member; and FIG. 5 is a sectional view along the line 5—5 of FIG. 4 showing the latching bar extending into the vertical frame member and depicting capture of the latching bar.

DETAILED DESCRIPTION OF THE PREFERRED EMBODIMENT

Attention is first directed to FIG. 1 of the drawings which shows a set of burglar bars to be installed in a window or other building opening to exclude intruders. It incorporates the inside latch mechanism to be described. Perhaps to place the context better, the entire assembly shown in FIG. 1 will be described first and the latch of the present disclosure will thereafter be set forth in some detail. The numeral 10 therefore identifies the entire burglar bar system. There is a first set of burglar bars comprising a rectangular framework at 11. This framework includes top and bottom horizontal members and vertical bars and terminates at an upstanding frame member 12. The frame member 12 can be used as an anchor for the hinges 13. The hinges 13 alternately can be anchored on the window frame member which comprises a portion of the building when installed. In any event, the left hand portion is fixed or anchored, but movement is permitted by the axis of rotation defined through the hinges 13.

The numeral 14 identifies a gate which is supported on the hinges. This gate is formed to exclude intruders. It has a horizontal frame member 15 across the bottom and a top frame member 16. The gate has suitable width to span the open space such as a window opening. There are vertical bars 17 spaced so that an intruder is denied entry through the gate. The frame members 15 and 16 are supported with upright similar frame members 18 and 19 which define a rectangle. The rectangular border of heavy frame members supports the bars 17. The four frame members making up the border are preferably hollow and are fairly large while the bars 17 are typically solid and somewhat smaller. The gate 14 is assembled by welding or the like to assure a solid unyielding structure. It is mounted for rotation inwardly into the room on the hinges 13.

The lock means of the present disclosure is indicated generally as 20. It is supported on an upstanding hollow frame member 21. The frame member 21 is fastened by suitable fasteners such as long self-threading and self-tapping bolts or the like and is anchored on an upstanding frame member which is a part of the window frame. Such a frame member is identified at 22 in FIG. 2. FIG. 2 further shows the approximate location of the window 23 which is secured by the installed burglar bar system at 10. FIG. 2 further shows how the present system moves to a closed latching and fastened position to provide the certainty of protection that one seeks when installing a burglar bar system in windows. That is, the gate 14 has been closed and latched and is held against further opening especially opening by an intruder. In the typical situation, an intruder may break the window 23 and attempt to reach through the bars 17. The intruder is denied entry because the present apparatus is constructed so that the intruder must reach completely around the lock means 20 and insert his hand through the opening at 23. The opening at 23, located on the side face of the lock means 20, is so arranged that opening from that position is simply impossible.

Continuing with FIG. 2, a latching bar 24 is supported on the gate 14. It is clamped and held to assure latching. The frame member 21 which is anchored and held in a fixed upright position is cut with a U-shaped notch to permit entry of the latching bar 24 to the illustrated position in FIG. 2. This notch requires a cut into the frame member 21 which occurs on two faces. The frame member 21 is rectangular or even square; the cut penetrates on two faces and is shown by the cut portion 25 in FIG. 5 and the continuous cut portion 26 shown in FIG. 4. The cuts 25 and 26 are continuous; that is, they abut at the corner of the frame member 21 and extend along the sides and have sufficient depth to receive the latching bar 24. The latching bar 24 thus is mounted on the gate 14 so that, on rotation about the axis defined by the hinges 13, the pin 24 is moved along the locus defined by the hinges and swings into the two cuts 25 and 26. The frame member 21 is parallel to and located in the same plane as the gate 14. This therefore directs the latch bar 24 into the two cutouts or notches. Moreover, this arrangement of the latch bar relative to the cutouts or notches at 25 and 26 defines a locking system.

The bar stock which comprises the latch bar 24 is preferably made of hardened metal, and preferably extends through the vertical frame member 18 as for instance through a drilled hole therein and is welded to it to assure relatively solid construction. Moreover, this type construction prevents easy defeat of the latch bar as for instance by using a hack saw on the exterior to cut through the latch bar 24. If there is some measure of risk that the bar 24 will be defeated in this fashion, a short plate 27 is welded on the vertical fixed frame member 21 to cover over the region where the latch bar is located. This plate 27 is added in FIG. 3 to show how it is preferably taller than the diameter of the latch bar 24. For ultimate protection, the plate 24 is a treated plate having a surface which includes embedded particles of tungsten carbide. This is sufficient to defeat most cutting tools and the like. The plate 27 is thus fixed on the vertical frame member 21 and located relative to the gate so that the latch bar is shielded when view from the exterior.

As shown in the drawings, the frame member 21 is hollow and rectangular and extends upright as shown in FIGS. 3, 4 and 5. It comprises an axially hollow member and serves as a guide for a smaller rectangular piece of stock which is shaped in a particular fashion. The piece on the interior is made smaller so that it can slide in telescoping movement. Indeed, the interior surface of the frame member 21 can be internally coated with a material which provides a slick surface. One such material is cadmium plating. An alternate is Teflon coating of the surface. A smoother surface is helpful to permit movement of the member on the interior.

The interior supports a lock member 30 which is formed of matching rectangular stock and which fits snugly within the frame member 21. The rectangular frame stock which makes up the lock member 30 has four sides and thereby defines a smaller member which is free to move on the interior. It is rectangular in cross section as shown in FIG. 2 of the drawings. It has a length that will be described. The rectangular stock has four faces, and one of the four faces is cut with a U-shaped slot 32 shown in dotted line in FIG. 5, the slot having a width slightly greater than the width of the bar 24 for locking purposes. It has a width so that it can reach around or on both sides of the locking bar to hold the locking bar as shown in FIG. 5. This permits the bar 24 to extend on the interior of the lock member 30. The lock member travels upwardly and downwardly. It is shown in the raised condition in FIGS. 3, 4 and 5. Locking member 30 is hollow in the interior to permit the bar to extend to the interior. The U-shaped slot 32 slides over the latch bar and encloses it after the latch bar has passed through the notches 25 and 26 formed in the side of the frame member 21. This holds in a fashion to prevent further movement of the latch bar 24.

A spring finger 34 extends downwardly from the locking member 30 and has a lower tip which is aligned so that it catches on a transverse pin 36. The pin 36 serves as a catch for the lock spring 34 which is made of leaf spring material and which is therefore quite bendable. The leaf spring is tack welded at the upper end and the lower end is deflected so that it would otherwise drag along the wall of the surrounding frame member 21. This permits it to ride over and catch on the transverse bar 36. This assures proper locking so that the lock member 30 is held in a raised position. When released, it simply drops downwardly as will be described.

Opening proceeds in the following fashion. A rectangular housing which encloses the apparatus is open along the face 23. That is the preferred face through which the operator can reach. A second opening is included and it is on the inside of the housing and is identified by the numeral 40. The opening 40 represents a rectangular cut out in the side wall of the frame member 21, but this rectangular cut out is totally within the housing. The housing is provided with the open wall or opening at 23; the user then must curl his fingers to reach through, and must reach through two openings. The first opening encountered is the opening in the housing at 23 and the second opening is the opening 40. The two openings are at right angles with respect to each other. Since two openings are dealt with and the two openings at right angles, the user is, loosely speaking, curling his fingers around the frame member 22, shown in FIG. 2. In other words, finger engagement of the structure requires the user to curl his fingers around the frame member 22, reach into the opening 40 and disengage the locking means 34 for gravity movement of the member 30. When this occurs, full release has been accomplished.

Opening of the present apparatus is gravity powered. Recall in FIGS. 3 and 4 that the lock means 30 is at the raised position. It is held up by the spring-like leaf shaped finger 34 which extends downwardly. That is released by finger engagement wherein the spring shaped member 34 is hand manipulated to ride over the transverse bar 36. This then permits the entire structure to slide downwardly. It can travel downwardly only to the limit permitted by the transverse bar 36 which serves as a stop. It is a stop when the lock member 30 is in the up position, but it is also a stop to prevent over travel in the downward direction. Once the lock member 30 has been moved downwardly, it can be raised quite easily by hand operation by reaching through the openings 23 and 40.

OPERATION AND PROTECTION AGAINST BURGLARS

When the equipment is installed as shown in FIG. 1 of the drawings, the housing is located in the room and is secured from inclement weather. Assume for purposes of description that an intruder breaks the window and attempts to reach through the burglar bars. The intruder is prevented from reaching inside the housing. The intruder is going to be defeated by this burglar bar system of the present disclosure and particularly will not be permitted to disengage the gate and thereby make clandestine entry. By contrast, the present apparatus is easily switched between the latched and unlatched positions. In the unlatched position, the lock means 30 is permitted to slide downwardly. Such movement can be obtained by hand engagement of the user as noted above. Once it moves downwardly, the latch bar 14 is free to be engaged. Latching is achieved quite easily. With the lock member 30 in the down position, the gate is simply closed to position the latch bar 24 inside the cut outs as shown in FIGS. 3, 4 and 5. At this juncture however, the locking member 30 is in the down position. It is simply raised by hand engagement. The U-shaped notch 32 grasps the latch bar 24 and prevents any escape, thereby completing the closing and latching movement. With the opening 23 directed away from the window which is protected by the burglar bar system, an intruder on the exterior assuming that he can reach between the vertical bars 18 still is in no position to grasp the mechanism and thereby open the lock.

Because many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A burglar bar system for restricting entry comprising:

(a) a gate for blocking entry including:

(i) protecting bars for an opening;

(ii) hinges securely attached relative to an opening being protected adjacent an interior area, where said hinges allow inward rotation of said gate;

(iii) a latch bar protruding from said gate for cooperatively preventing rotation;

(b) a frame member independent of said gate and securely attached adjacent said opening and wherein said frame member supports a receiving means for said latch bar, said receiving means restricting rotation of said gate by receiving said latch bar;

(c) a lock means supported by said frame member for locking said gate and wherein said lock means includes (i) a housing mounted on the face of said frame member facing said interior area to restrict hand manipulation of said lock means to persons in the area to be protected by said burglar bar system and wherein said housing has an opening remote from said gate permitting access to a second opening in said frame member by a person's hand entering said remote housing opening in a plane parallel to said gate; and (ii) a lock member within said frame member to engage and restrict said latch bar and wherein said lock member is accessed only by a person's hand entering said opening in said housing and also entering said second opening.

2. The apparatus of claim 1 wherein said receiving means includes a U-shaped notch in said frame member to permit entry of said latch bar, the U-shaped notch penetrating said frame member near the area being protected, said notch being exposed at an edge of said frame member and having a sufficient depth to receive said latch bar.

3. The apparatus of claim 1 wherein said latch bar and said lock means cooperatively prevent rotation of said gate when said gate is parallel to the opening by said lock member preventing said latch bar from exiting said receiving means.

4. The apparatus of claim 1 wherein said second opening allows access to said lock member and is sufficient in size for one or more fingers of the person to enter by placing the palm of the person's hand toward said frame member and curling "the" one or more fingers into said "housing" second opening.

5. The apparatus of claim 2 wherein said lock member has sufficient length to cover said U-shaped notch in said frame member while locked, the lock member having a lock member notch on the gate side of said lock member to capture and restrict said latch bar after upward movement into the locked position.

6. The apparatus of claim 5 wherein said lock member has a spring attached, said spring extending away from the lower portion of said lock member and contacting the interior of the housing nearer said gate, said spring restricting movement while in the locked position.

7. The apparatus of claim 6 wherein the frame member has a spring stop affixed to said interior, and wherein said spring stop cooperatively restricts movement of said lock member while in the locked position.

8. The apparatus of claim 7 wherein the rotation of said gate is restricted by manually moving said lock member upward after said latch bar has entered said U-shaped notch.

9. The apparatus of claim 8 wherein movement of said lock member to the unlocked position is restricted on movement of said lock member sufficiently past said spring stop so that said spring restricts movement by contacting said spring stop.

10. The apparatus of claim 9 wherein hand release by the person moves said spring a sufficient distance away from said interior to clear said spring stop and to allow movement of said lock member by a distance sufficient to allow said lock member notch to clear said latch bar thereby releasing said gate.

* * * * *